United States Patent [19]

Bucher

[11] Patent Number: 4,457,142

[45] Date of Patent: Jul. 3, 1984

[54] METHOD OF CHILLING MATERIALS AND CHILLING CONTAINER

[75] Inventor: Peter Bucher, Pfäffikon, Switzerland

[73] Assignee: Firma Heinrich Bucher, Switzerland

[21] Appl. No.: 433,966

[22] Filed: Oct. 13, 1982

[30] Foreign Application Priority Data

Oct. 16, 1981 [CH] Switzerland ..... 6635/81

[51] Int. Cl.[3] ..... F25D 3/12

[52] U.S. Cl. ..... 62/388; 62/459

[58] Field of Search ..... 62/384, 385, 388, 459

[56] References Cited

U.S. PATENT DOCUMENTS 3,163,022 12/1964 Hottenroth ..... 62/388
3,864,936 2/1975 Frank et al. ..... 62/385
3,866,435 2/1975 Frank et al. ..... 62/388

FOREIGN PATENT DOCUMENTS 2054115 2/1981 United Kingdom .

*Primary Examiner*—Ronald C. Capossela
*Attorney, Agent, or Firm*—Roylance, Abrams, Berdo & Goodman

[57] ABSTRACT

A chilling container includes a chilling agent chamber and a chilled goods chamber. The chilling agent chamber is sealed shut to contain e.g. dry ice, is highly insulated from the outside, and is connected by a pressure passage system to the chilled goods chamber which has an opening to the outside and a door. The chilling agent is vaporized in the chilling agent chamber by removal of the heat. A pressure drop occurs and therewith a forced movement with a forced circulation of the vaporized gases into the chilled goods chamber. A wall containing the pressure passage system is cooler and is opposite the door causing convection circulation which reinforces the forced circulation. A wall separating the chambers is relatively highly heat conductive.

6 Claims, 1 Drawing Figure

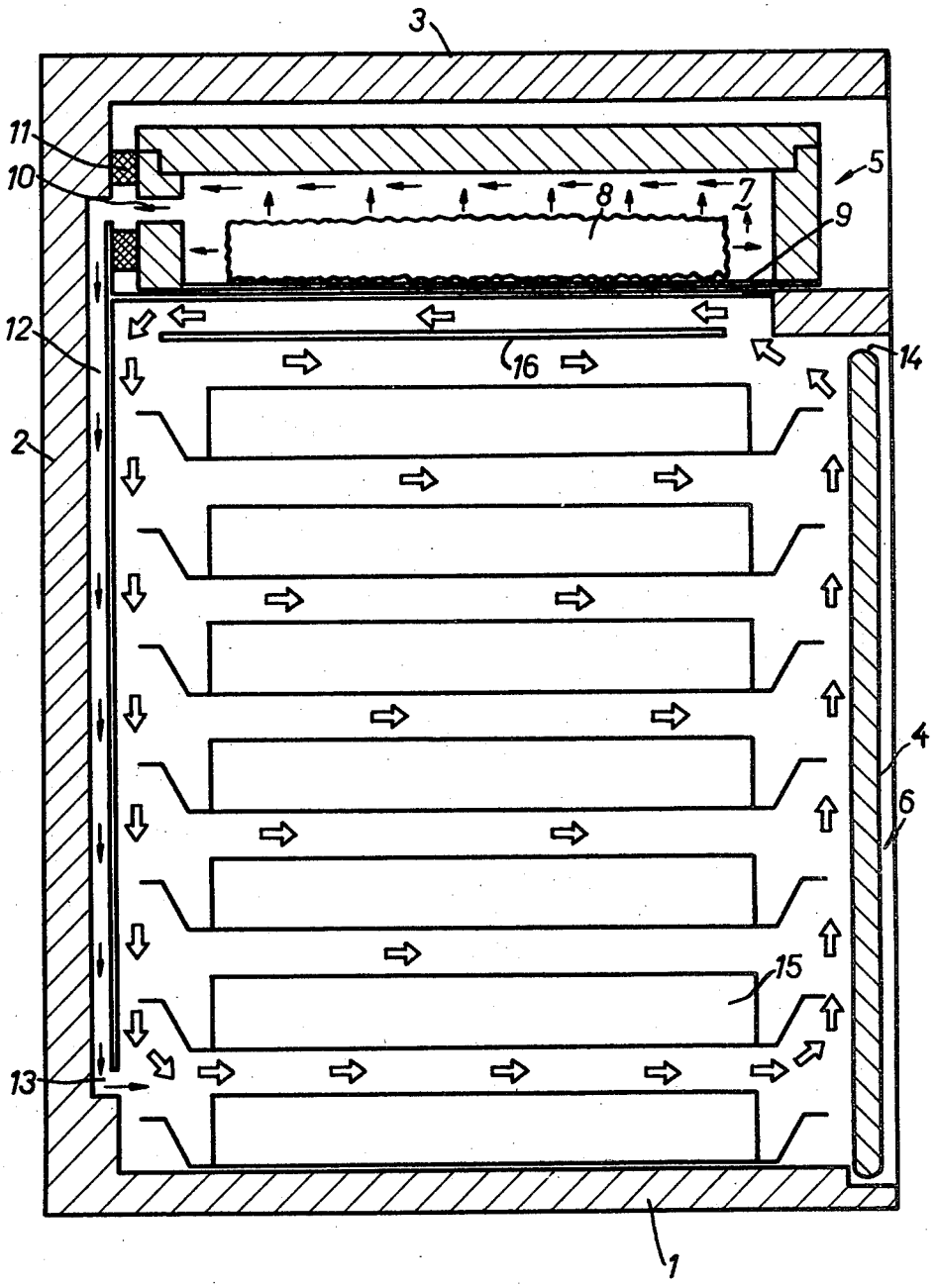
3
11
10
5
8
7
9
12
16
14
2
4
6
15
13
1

METHOD OF CHILLING MATERIALS AND CHILLING CONTAINER

This invention relates to a method for chilling articles or materials in a container using a chilling agent and to a container for chilling the materials of the type having a chamber for the materials to be chilled and a chamber for the chilling agent.

BACKGROUND OF THE INVENTION

It is, of course, well known to provide a container for chilling materials such as food or the like, which includes maintaining perishable articles in a chilled condition, where the containers operate independently of outside energy sources. This is particularly true of containers which are designed to be portable. Such devices are known in various embodiments and for use in various sets of circumstances, particularly transportable containers such as are used in the transportation of goods such as by rail and air transport. With the use of a suitable chilling agent, e.g., solidified carbon dioxide, commonly known as "dry ice", in such containers, the material to be chilled can be held for a considerable length of time below the temperature of the ambient environment. Such containers are also used to carry prepared meals and supplies of food stuffs for service to air or rail passengers. In such cases, Departments of Health commonly require that the meals or food stuffs for service are maintained within a certain temperature range until just before serving.

The manner of operation of such containers for chilled goods resides in the fact that the dry ice, which is generally used as the cooling agent, vaporizes or sublimes upon contact with the heat from surrounding atmosphere or from the container, and that the cold gas resulting therefrom, which is heavier than air, is carried by the effect of gravity into the tank which contains the material to be chilled. Thus, so long as the dry ice supply lasts, the transfer of heat into the container can be entirely or at least partially controlled and compensated for by the insulated walls of the container.

In a known container for such material, the inside chamber is subdivided into a cooling agent part to carry the cooling agent and a chilled material part for the storage of the chilled material, and the cooling agent part is found directly below the cover of the container. However, since the cooling agent part is only insufficiently insulated from the outside, the sublimation or vaporization heat of the dry ice is drawn for the most part from the environment and, thus, the chilled goods are not so effectively chilled. Since the sublimation heat from dry ice can have a more extensive cooling effect than the cold carbon dioxide gases arising therefrom, the losses are great with such known containers and they have a low degree of thermal effect and also the cooling effect is not uniform in the chamber containing the material to be chilled and preserved. Indeed, in those regions closest to the cooling agent, the material can be excessively cooled.

BRIEF DESCRIPTION OF THE INVENTION

An object of the present invention is to provide a container for maintaining materials at a chilled level which provides great improvement in the thermal effectiveness by increasing the circulation speed of the cold gases in the part of the container receiving the material to be chilled, and which controls the circulation.

A further object is to provide an improved method of chilling material in a container using a transportable chilling agent wherein the pressure of the subliming or vaporizing chilling agent is employed to improve the uniformity and effectiveness of the cooling process and wherein the heat for causing the agent to sublime is drawn from the food chamber.

Briefly described, the invention includes a method of chilling material in a container using a transportable chilling agent, wherein the container is of the type having a first chamber for containing the material to be chilled and a second chamber for the chilling agent, comprising providing a first passage between the first and second chambers and a second passage between the first chamber and the ambient atmosphere; providing a pressure drop across the first chamber between the passages, thereby inducing forced passage of chilling agent through the first chamber and forced circulation and mixing of the cooling agent throughout the first chamber.

In another aspect, the invention includes a container for chilling material using a transportable chilling agent, the container being of the type having a first chamber for the material to be chilled and a second chamber for the chilling agent, the combination wherein said second chamber is tightly sealed, and wherein said container includes means defining a relatively small discharge passage between said first chamber and the ambient atmosphere; and means defining a pressure passage between said second chamber and said first chamber, by which a pressure drop is created between said pressure passage and said discharge passage.

As will be recognized from the following discussion, it is important that the chamber containing the cooling agent be tightly sealed except for the pressure passage which interconnects that chamber and the chamber containing the foodstuff or other articles or materials to be maintained in a cold state. Further, it is important that the chamber receiving the materials to be chilled have a discharge opening, preferably of relatively small size and preferably near the upper limit of that chamber, through which the highest temperature gas therein can be ejected, thereby establishing a pressure differential across the material-receiving chamber which can be employed to induce mixing and circulation, contributing to the uniformity of the cooling effect.

In order that the manner in which the foregoing and other objects are attained in accordance with the invention can be understood in detail, a particularly advantageous embodiment thereof will be described with reference to the accompanying drawing, which forms a part of this specification, and which shows a side elevation, in partial section, of a container in accordance with the invention, which container is capable of performing the method of the invention.

As illustrated in the drawing, a container in accordance with the present invention includes a plurality of insulated walls defining the exterior of the container, the walls including a bottom wall 1, a rear wall 2, and a top wall 3 and side walls. The lower portion of this container comprises a first chamber 6 for receiving the materials to be chilled, and this chamber 6 is accessible through a door 4 which is also insulated and which is openable to permit insertion and removal of articles 15 which are shown only as rectangles resting on shelves symbolically indicating any kind of material to be stored therein.

The inside volume of the cooling container is subdivided into the somewhat larger portion comprising the first chamber 6 for the chilled goods, and a chilling agent or second chamber 5, which in the embodiment illustrated, is simply an open-sided cavity. A smaller container 7 which actually contains the cooling agent 8, such as dry ice, is inserted into the upper chilling agent chamber 5 and is removable therefrom, the walls of container 7 being well insulated and sealed except for an opening 10 at the rear thereof and except for the bottom wall 9 which is less insulated or is completely uninsulated and is thereby highly heat conductive as compared with the other walls. Thus, there is minimum heat conduction between the interior of container 7 and the ambient atmosphere minimizing the vaporization heat which is drawn from the outer atmosphere which would otherwise lead to a decrease of the thermal effectiveness of the entire container.

To attain satisfactory functioning of such a container, a uniform temperature distribution within the material-chilling part of the container is essential. Because of the temperature differential between carbon dioxide gas, the sublimation temperature of solid $CO_2$ being −78.5° C. at 760 Torr, and the chilled materials, for which a temperature of between 6° and 18° C. for food stuffs and meals suffices, the gases must be circulated and mixed within chamber 6. This is attained as follows:

The opening 10, which can be a plurality of openings formed in the rear wall of container or tank 7, is sealed in a pressure-tight manner by a soft packing material 11, such as an elastomeric material which surrounds an opening leading to a pressure passage 12 which is integrated into the rear wall 2 of the chilled goods chamber. At the other end of passage 12, there is at least one opening 13 which opens into chamber 6 and which preferably lies in the vicinity of the bottom wall 1. Chamber 6 also includes means defining at least one discharge opening 14 which is preferably at door 4 and near the upper portion of chamber 6.

As heat reaches the solidified cooling agent, the cooling agent vaporizes or sublimes, increasing the pressure within tank 7. This pressure creates forced flow of gas through passage 12 and opening 13 into chamber 6 and, thereby, out of discharge opening 14. Thus, a substantially continuous flow of chilling gas through chamber 6 is provided, resulting from the pressure drop or pressure differential across chamber 6 between openings 13 and 14. In addition, by locating the openings at spaced points in chamber 6, particularly as shown in the figure, forced circulation results throughout chamber 6 as indicated generally by the arrows.

An additional improvement results because of the temperature differential between the inner surfaces of door 4 and wall 2, wall 2 with its passage 12 being colder than the inside surface of less-insulated door 4, thus creating a tendency for the gas adjacent door 4 to rise and adjacent wall 2 to fall, creating a convection current within chamber 6 which aids the circulation initially induced by the pressure differential. The embodiment shown is, of course, only one manner in which the convection effect can be induced, and it will be recognized by those skilled in the art that other "cold" and "warm" wall arrangements can be employed.

The described configuration of the chilled material container therefore provides that the gases resulting from the sublimation of the cooling agent flow in a forced movement with forced circulation through the material chamber 6 which, by the arrangement of relatively colder and warmer walls, further reinforces this forced circulation by a convection affect, and the heat for the vaporization or sublimation of cooling agent 8 is removed from the chilled materials chamber 6 because of the relatively greater heat movement through the poorly insulated barrier 9 between the chambers. The result is a chilled goods container which guarantees uniform cooling of the chilled goods 15 and which has high thermal efficiency. If the cooling effect should prove to be too intense at regions of chamber 6 it is possible to provide a shield such as barrier 16, using plates or foils, in the vicinity of the cooling agent container 7 or opening 13.

The described container can also be modified in more complicated fashions such as by providing the pressure passage system 12 in two or more walls instead of only one wall. It will also be readily recognized that a plurality of openings 13, 14 can be provided and these can be arranged at other points. Further, wall 9 can be slightly insulated or totally insulated, but it is important to maintain both the pressure and convection or thermosiphon effects.

While one advantageous embodiment has been chosen to illustrate the invention, it will be understood by those skilled in the art that various changes and modifications can be made therein without departing from the scope of the invention as defined in the appended claims.

What is claimed is:

1. A container for chilling material received therein via a chilling agent, the combination comprising:

a first closed chamber for receiving the material and having insulated walls including an insulated door;

a second closed chamber for receiving the chilling agent therein, said second chamber being insulated and located above said first chamber; and means for creating a forced flow, via a pressure differential, of the chilling agent from said second chamber, down a first wall of said first chamber, and into and then out of said first chamber, and for creating convection currents of the chilling agent in said first chamber, said means comprising a continuous pressure passage extending along said first wall of said first chamber, an upper opening in said pressure passage located adjacent said second chamber and communicating with the interior of said second chamber, said upper opening being smaller in dimension relative to the interior of said second chamber, a lower opening in said pressure passage located adjacent the bottom of said first chamber and communicating with the interior of said first chamber, and a second upper opening located adjacent the top of said first chamber and leading to the atmosphere, said second upper opening being located in a wall of said first chamber other than said first wall, said continuous pressure passage having no openings therein between said upper and lower openings.

2. A container according to claim 1 wherein said first and second chambers share a common wall which separates said chambers and which is substantially uninsulated.

3. A container according to claim 1 wherein said lower opening into said first chamber from said pressure passage and said second upper opening to the atmosphere from said first chamber are disposed at opposite extreme locations of said first chamber.

4. A container according to claim 1 wherein said first wall of said first chamber contains means defining said pressure passage.

5. A container according to claim 1 wherein said first chamber walls are insulated to different degrees, thereby allowing the inner surfaces of said walls to reach different temperatures to further induce convection currents in said first chamber.

6. A container according to claim 1 wherein said chilling agent comprises solidified carbon dixoide.

* * * * *